US008378566B2

(12) United States Patent
Lin

(10) Patent No.: US 8,378,566 B2
(45) Date of Patent: Feb. 19, 2013

(54) CERAMIC-GLASS COMPOSITE ELECTRODE AND FLUORESCENT LAMP HAVING THE SAME

(75) Inventor: Wen-Fei Lin, New Taipei (TW)

(73) Assignee: Santoma (H.K.) Ltd., Kowloon (HK)

( * ) Notice: Subject to any disclaimer, the term of this patent is extended or adjusted under 35 U.S.C. 154(b) by 0 days.

(21) Appl. No.: 13/242,763

(22) Filed: Sep. 23, 2011

(65) Prior Publication Data

US 2012/0212121 A1 Aug. 23, 2012

(30) Foreign Application Priority Data

Feb. 21, 2011 (CN) ..... 2011 2 0045507 U

(51) Int. Cl.
*H01J 1/62* (2006.01)

(52) U.S. Cl. ..... 313/491; 313/493; 313/631; 313/634

(58) Field of Classification Search ..... 313/491, 313/493, 634, 631
See application file for complete search history.

(56) References Cited

U.S. PATENT DOCUMENTS 2,847,605 A * 8/1958 Byer ..... 313/346 DC

FOREIGN PATENT DOCUMENTS

TW 200842928 11/2008

* cited by examiner

*Primary Examiner* — Vip Patel
(74) *Attorney, Agent, or Firm* — Muncy, Geissler, Olds & Lowe, PLLC

(57) ABSTRACT

The present invention provides a ceramic-glass composite electrode and a fluorescent lamp having the same. The ceramic-glass composite electrode according to the present invention is a ceramic-glass composite, which is disposed at the ends of a glass tube of the fluorescent lamp. A stopper is disposed at the end of the glass tube for pushing against the ceramic-glass composite electrode and limiting the position of the ceramic-glass composite electrode slipped on the glass tube. Thereby, flowing of adhesives into the glass tube is avoided when the adhesives are used for gluing the glass tube and the ceramic-glass composite electrode, and hence extending the lifetime of the fluorescent lamp.

10 Claims, 10 Drawing Sheets

CERAMIC-GLASS COMPOSITE ELECTRODE AND FLUORESCENT LAMP HAVING THE SAME

FIELD OF THE INVENTION

The present invention relates generally to an electrode and a fluorescent lamp, and particularly to a ceramic-glass composite electrode and a fluorescent lamp having the same, which can prevent adhesives from entering the glass tube of the fluorescent lamp and hence extending its lifetime.

BACKGROUND OF THE INVENTION

FIG. 1 shows a cross-sectional view of a cold-cathode fluorescent lamp in a backlight module according to the prior art. The fluorescent lamp 100 comprises a glass tube 120, which includes a pair of cup-shaped metallic electrodes 110 inserted in its both ends and two leads 130 connected to the ends of the two metallic electrodes 110. While manufacturing the fluorescent lamp 100, even the fluorescent lamp 100 is pumped to a certain vacuum level, primary electrons still naturally appear therein owing to the appearance of cosmic rays. In the fabrication process of the fluorescent lamp 100, after vacuuming, the fluorescent lamp 100 is filled with a neon-argon (Ne—Ar) gas 150 in a pressure above 50 torr. When a high AC voltage is applied to the metallic electrodes 110 at both ends of the fluorescent lamp 100, the primary electrons will be accelerated by electric field and hence ionizing the Ne—Ar gas 150. When the ionization persists, spark plasma is formed, in which cations 160 and negative electrons 140 coexist. The cations 160 and the electrons 140 scatter the two metallic electrodes 110 and thereby are neutralized. Under such circumstance, secondary electrons are produced from the two metallic electrodes 110 owing to the scattering and thus enabling continuous discharging. Accordingly, production of secondary electrons is a significant factor for implementing continuous light emission. If emission of secondary electrons is supported, high brightness will be maintained.

When the electrons 140 scatter neutral mercury atoms 170, the latter will be excited. When the excited mercury atoms 170 return to the ground state, they can emit UV light 180. The UV light 180 will emit to the phosphorus 190 coated on the inner sidewalls of the glass tube 120, and thus converted to visible light 181. Thereby, the electrons 140 or the cations 160 bombard the metallic electrodes 110 and sputter there. The scattered metallic electrode material after sputtering will adhere to the mercury atoms 170 and form a complex. When the complex is deposited around the metallic electrodes 110, darkening phenomenon occurs, which leads to shortening of the lifetime of the fluorescent lamp 100 and bring a major issue to the fluorescent lamp 100.

To overcome the problem, several methods are proposed. (1) A method for reducing the initial discharge voltage by using the Penning effect according to the stimulation ad ionization of the Ne—Ar gas 150 filled in the fluorescent lamp 100. Thereby, bombardments of the electrons 140 or cations 160 on the metallic electrodes 110 can be reduced, and thus weakening sputtering. (2) A method for reducing the initial discharge voltage by lowering the air pressure to the possible lowest. Nonetheless, when the initial discharge voltage is very low, the kinetic energy on the cations 160 or the electrons 140 bombarding the metallic electrodes 110 is reduced and thus reducing emission of secondary electrons from the metallic electrodes 110. Consequently, the brightness of the fluorescent lamp 100 is weakened.

For conquering this problem, another method is proposed. This method selectively adopts materials with low a work function as the metallic electrodes 110 for facilitating electron supply. Nevertheless, this method will increase the manufacturing cost owing to the costly price of the materials. In addition, this method also need to use expensive borosilicate as the material of the glass tube 120 for adjusting the heat expansion coefficients of the glass tube 120 and the leads 130. Moreover, the fluorescent lamp 100 has a low resistivity, and thereby its resistive component will be obviously high. Hence, one transformer can only drive a single fluorescent lamp 100, resulting in overall manufacturing cost increased. Besides, because the diameter of the glass tube 120 is increased, brightness will be drastically reduced and the mechanical strength of the fluorescent lamp 100 is relatively weaker. Accordingly, the fluorescent lamp 100 described above is not easy to be applied to large-size televisions that need a large-diameter fluorescent lamp (with a diameter greater than 4 mm) as the backlight.

To solve the problem describe above, a fluorescent lamp having external electrodes is developed. As shown in FIG. 2, conductive layers 221 are disposed on the outer surface of both ends of the glass tube 210, respectively. Alternatively, both ends of the glass tube 210 are covered by and contact with metallic caps 220, respectively. According to the fluorescent lamp 200 having external electrodes shown in FIG. 2, phosphorus is coated on the inner surface of the glass tube 210 and both ends thereof are sealed. The inner space of the glass tube 210 is filled with mixture containing charged gas, including, for example, inert gas such as Ar or Ne and mercury (Hg) gas. The conductive layers 221 have various shapes and are disposed on the outer surface of both ends of the glass tube. They can be made of silver or carbon. Beside, metallic caps 220 are disposed on both ends of the glass tube 210, respectively.

When a high AC voltage is applied to the conductive layers 2210, both ends of the glass tube 210 contacting with the metallic caps 220 act as a dielectric material for producing a strong induced electric field. More specifically, when the polarity of the voltage applied to the metallic cap 220 is positive, electrons are accumulated in the glass tube 210 contacting with the conductive layer 221. On the other hand, when the voltage is negative, cations are accumulated in the glass tube 210 contacting with the conductive layer 221. Because AC electric field changes polarities continuously, the charges accumulated on the sidewalls of both ends of the glass tube 210 interchange. Hence, when the charges on the sidewalls bombard the Hg gas supplied along with the inert gas, the Hg atoms will be excited. Then, the UV light produced during this excitation process can excite the phosphorus coated on the inner sidewalls of the glass tube 210 and thus emitting visible light.

In a conventional fluorescent lamp 200 with external electrodes, because the regions at both ends of the glass tube 210 act as a dielectric material and have the conductive layer 221, the end regions will be enlarged and hence increasing the amount of sidewall charges and, in turn, increasing the brightness of the fluorescent lamp 200. Nonetheless, the conductive layer 221 is limited while extending in the longitudinal direction. Thereby, the radiated light of the conductive layer 221 will be reduced in the longitudinal direction, leading to reduction of light-emitting efficiency.

Owing to the drawbacks described above, Taiwan patent publication number 200842928 entitled "Fluorescent Lamp Having Ceramic-Glass Composite Electrode" disclosed a ceramic-glass composite electrode, which is a composite of ceramic and glass having a higher dielectric constant and a better secondary electron emission efficiency. In addition, the ceramic-glass composite electrode owns higher polarity under the same electric field, and thereby more electrons and cations can be moved, resulting in improved brightness of the fluorescent lamp. As shown in FIG. 3, the ceramic-glass composite electrode 300 exhibits a hollow cylindrical shape to be disposed at both ends of the glass tube. The ceramic-glass composite electrode 300 has two different inner radii 310, 313, in which the inner radius 310 is smaller than the inner radius 313. Accordingly, the inner side of the ceramic-glass composite electrode 300 is ladder-shaped. The inner radius 313 is slightly larger than the outer radius of the glass tube for allowing the ceramic-glass composite electrode 300 to slip on the end of the glass tube. Besides, the inner radius 310 is smaller than the outer radius of the glass tube.

Before the ceramic-glass composite electrode 300 slips on the glass tube, the outer surface at the end of the glass tube has to be coated with an adhesive and the ceramic-glass composite electrode 300 is disposed. Nonetheless, the dose of coating adhesive on the outer surface of the glass tube is difficult to be controlled. Thereby, excess or insufficient adhesives tend to be applied. If the adhesive is insufficient, the ceramic-glass composite electrode 300 cannot be fixed at the end of the ceramic-glass composite electrode 300 firmly; if excess adhesive is applied, it will spill into the glass tube, and thus contaminating the gas mixture in the glass tube and affecting the light-emitting efficiency and lifetime of the fluorescent lamp. In addition, because the inner radii of the ceramic-glass composite electrode 300 are different, it is difficult to fabricate, which means that process complexity and costs are increased. Thereby, how to prevent adhesives from flowing into the glass tube while slipping the ceramic-glass composite electrode 300 on the end of the glass tube has become a major issue at present.

Accordingly, the present invention provides a ceramic-glass composite electrode and a fluorescent lamp having the same for solving the problems described above. The present invention not only improves the above-mentioned drawbacks appeared in the prior art but also extends the lifetime of the fluorescent lamp.

SUMMARY

An objective of the present invention is to provide a ceramic-glass composite electrode, which is a hollow cylindrical with identical inner radii. Thereby, its structure is simple for achieving the purposes of convenient manufacturing and reducing costs.

Another objective of the present invention is to provide a fluorescent lamp having a ceramic-glass composite electrode, which includes a stopper at the end of the glass tube for pushing against the ceramic-glass composite electrode and limiting its position in the glass tube when the ceramic-glass composite electrode slips on the end of the glass tube. Thereby, flowing of adhesives into the glass tube, which affects the lifetime of the fluorescent lamp, is avoided when the adhesives are used for gluing the glass tube and the ceramic-glass composite electrode.

The fluorescent lamp having a ceramic-glass composite electrode according to the present invention comprises a glass tube, at least a stopper, and a plurality of ceramic-glass composite electrodes. The stopper is disposed at at least an end of the glass tube. The plurality of ceramic-glass composite electrodes are disposed at both ends of the glass tube, respectively, and pushes against the stoppers of the glass tube for limiting the positions of the ceramic-glass composite electrodes in the glass tube and for preventing adhesives from flowing into the glass tube. Thereby, the lifetime of the fluorescent lamp can be extended. The ceramic-glass composite electrode according to the present invention is a cylinder and is a ceramic-glass composite. The cylinder has only one inner radius, making its structure simple and convenient for manufacturing, and hence reducing the manufacturing costs.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
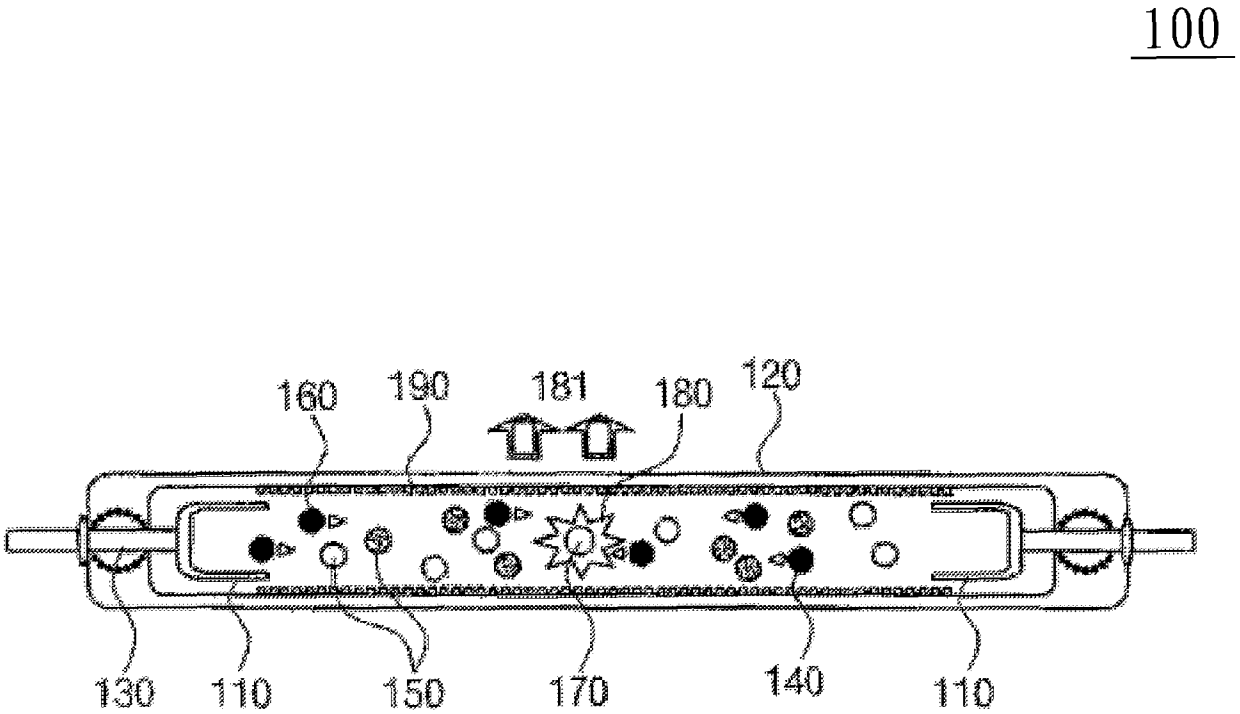
FIG. 1 shows a cross-sectional view of a cold-cathode fluorescent lamp in a backlight module according to the prior art.
Figure 2:
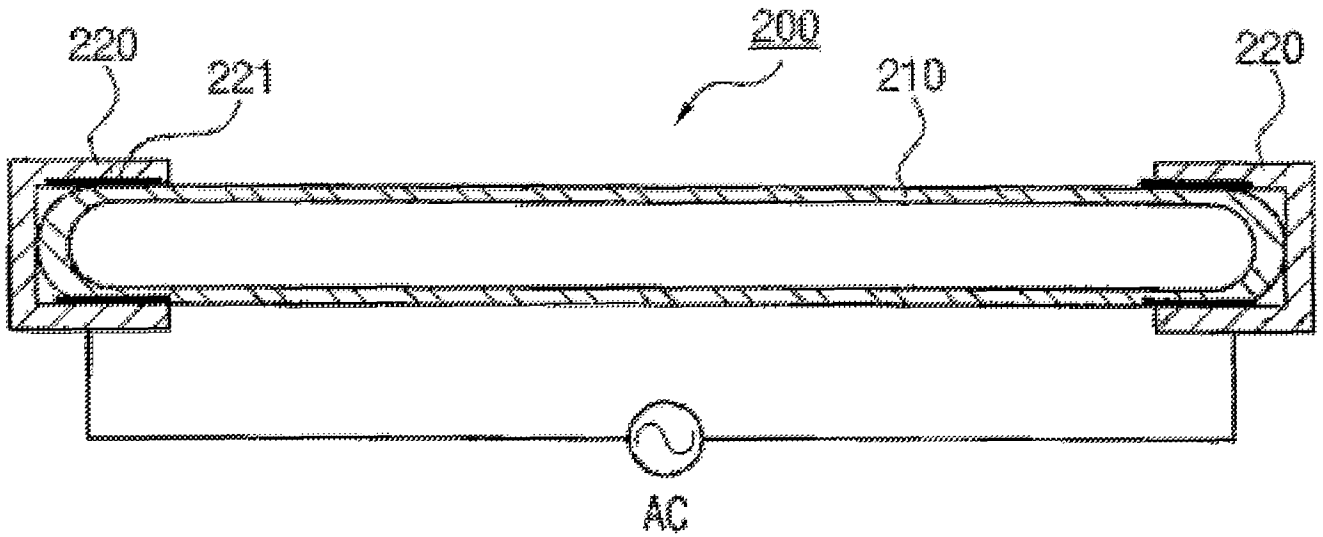
FIG. 2 shows a cross-sectional view of a fluorescent lamp having external electrodes according to the prior art.
Figure 3:
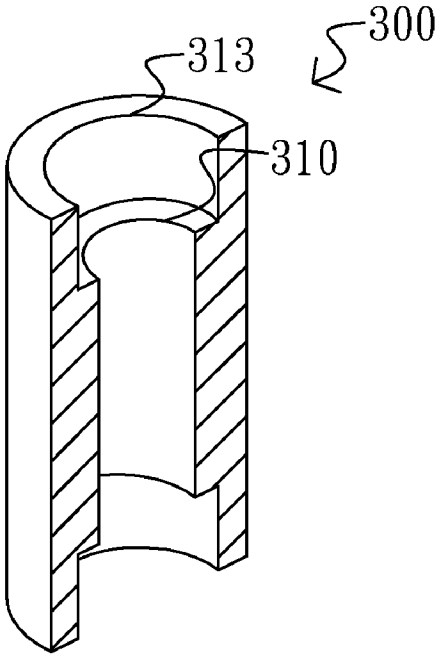
FIG. 3 shows a cross-sectional view of a ceramic-glass composite electrode according to the prior art.
Figure 4A:
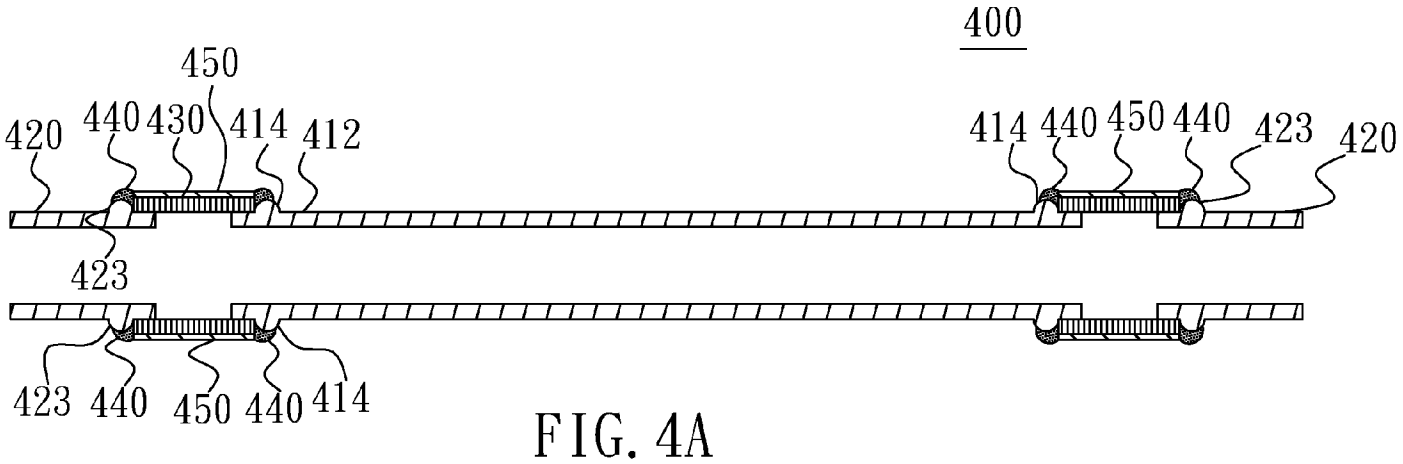
FIGS. 4A and 4B show cross-sectional views of a fluorescent lamp having ceramic-glass composite electrodes according to a preferred embodiment of the present invention.
Figure 4B:
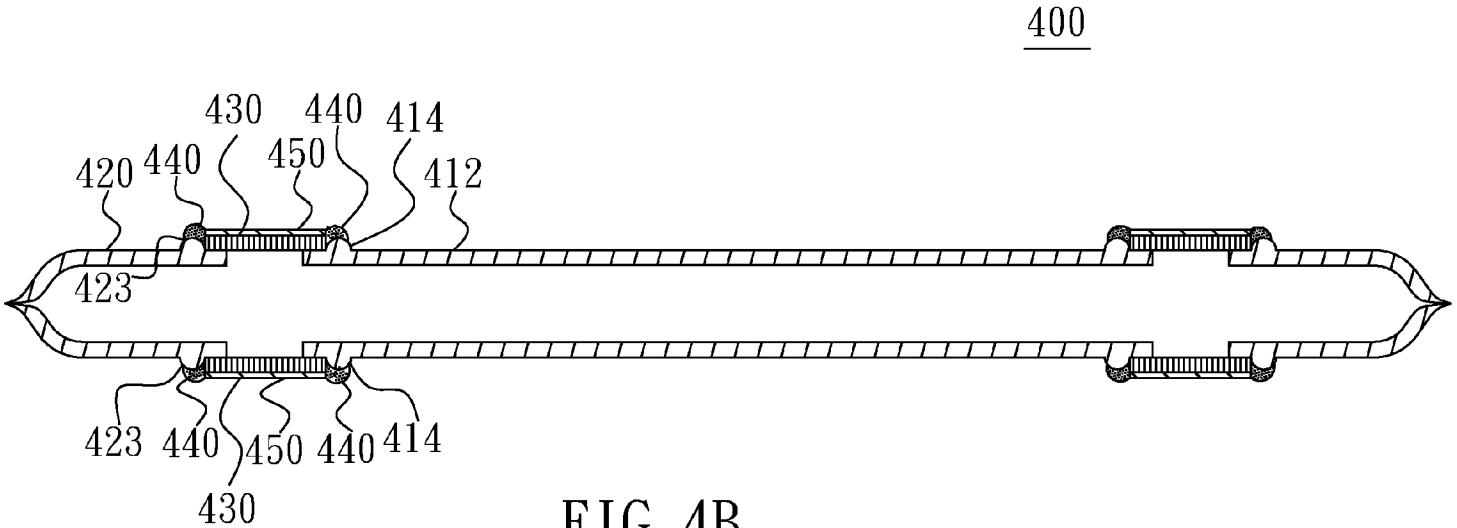

FIGS. 4A and 4B show cross-sectional views of a fluorescent lamp having ceramic-glass composite electrodes according to a preferred embodiment of the present invention. As shown in the figures, the fluorescent lamp 400 according to the present invention comprises a glass tube 412, a plurality of sealing assemblies 420, and a plurality of electrodes 430. The glass tube 412 has an inner space for accommodating a mixture of inert gas and metal vapor (not shown in the figures). In addition, the inner surface of the glass tube 412 is coated with phosphorus. The glass tube 412 can be pipe-, U-, or rectangle-shaped. In FIGS. 4A and 4B, the glass tube 412 is pipe-shaped. The glass tube 412 can be composed of borosilicate, leadless glass, or quartz. Besides, there is a stopper 414 at both ends of the glass tube 412. According to an embodiment of the present invention, the stoppers 414 are protrudent members and annular.

The plurality of electrodes 430 are ceramic-glass composite electrodes, which include ceramic-glass composites with the properties of high dielectric constants and high secondary electron emission efficiency. The plurality of electrodes 430 are slipped on both ends of the glass tube 412, respectively. An end of the plurality of electrodes 430 will push against the two stoppers 414 located at both ends of the glass tube 412, respectively. Thereby, the plurality of stoppers 414 are used for limiting the positions at which the plurality of electrodes locate on the glass tube 412, namely, for limiting the length the glass tube extending into the plurality of electrodes 430. The plurality of sealing assemblies 420 are disposed at the other end of the plurality of electrodes 430, respectively. One end of the plurality of sealing assemblies 420 has a stopper 423, respectively, for pushing against the end of the plurality of electrodes 430 and thus limiting the positions of the plurality of electrodes 430 located on the plurality of sealing assemblies 420, namely, for limiting the length the plurality of sealing assemblies 4210 extending into the plurality of electrodes 430. According to an embodiment of the present invention, the plurality of stoppers 423 are protrudent members and annular. As shown in FIG. 4B, after filing the mixture into the glass tube 412, heat process is performed on the plurality of sealing assemblies 420 for sealing the original openings of the plurality of sealing assemblies 420. By sealing the openings of the plurality of electrodes 430 in terms of the plurality of sealing assemblies 420, both ends of the glass tube 412 are sealed.

For further securing the plurality of electrodes 430 at both ends of the glass tube 412, after the plurality of electrodes 430 are slipped on both ends of the glass tube 412, an adhesive 440 is coated at the junction between the glass tube 412 and the plurality of electrodes 430 for fixing the plurality of electrodes 430 at both ends of the glass tube 412 and for avoiding leakage of gas filled later in the glass tube 412. The adhesive 440 is coated on the outer surfaces of the glass tube 412 and the plurality of electrodes 430. In addition, the adhesive 440 is further coated to the junction between the plurality of electrodes 430 and the plurality of sealing assemblies 420 for securing the plurality of sealing assemblies 420 on the plurality of electrodes 430. The adhesive 440 is coated on the outer surfaces of the plurality of electrodes 430 and the plurality of sealing assemblies 420. The heat expansion coefficient of the adhesive 440 is between those of the glass tube 412 and of the plurality of electrodes 430. When coating the adhesive 440 on the glass tube 412, the plurality of electrodes 430, and the plurality of sealing assemblies 420, heat process has to be performed with temperatures no higher than the softening point of the glass tube 412. Besides, the heat process is performed before vacuuming the glass tube 412 and filling the mixture to the glass tube 412.

Because the both ends of the electrode 430 will push against the stopper 414 of the glass tube 412 and the stopper of the sealing assembly 420, the adhesive will not flow into the electrode 430 and the glass tube 412. Thus, the mixture in the glass tube 412 will not be contaminated and the lifetime of the fluorescent lamp 400 will not be affected. Moreover, the fluorescent lamp 400 according to the present invention further comprises a plurality of conductive layers 450 disposed on the outer surfaces of the plurality of electrodes 430, respectively. According to an embodiment of the present invention, the material of the plurality of conductive layers 450 can be silver or carbon.

Figure 5A:
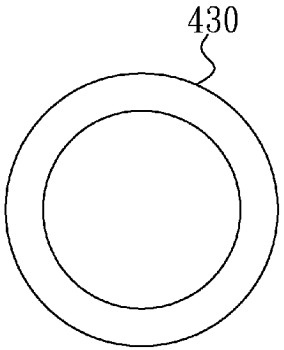
FIG. 5A shows a top view of a ceramic-glass composite electrode according to a preferred embodiment of the present invention.
Figure 5B:
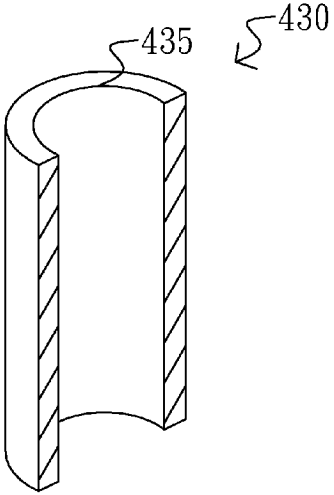
FIG. 5B shows a cross-sectional view of a ceramic-glass composite electrode according to a preferred embodiment of the present invention.

FIG. 5A and FIG. 5B show a top view and a cross-sectional view of a ceramic-glass composite electrode according to a preferred embodiment of the present invention. As shown in the figures, the electrode 430 has an electrode body 435, which is a ceramic-glass composite and is cylindrical. Besides, it is hollow and contains an holding space for being disposed at the end of the glass tube 412 of the fluorescent lamp 400 (as shown in FIG. 4A). Moreover, the electrode 430 has only one inner radius, making the inside of the electrode 430 straight tube-shaped; the inner radius of the electrode 430 is slightly greater than the outer radius of the glass tube 430 for facilitating slipping on the end of the glass tube 412. Thereby, the electrode 430 according to the present invention has a simple structure, which helps easy manufacturing and hence, in turn, improving production efficiency and reducing production costs. When the electrode body 435 slips on the end of the glass tube 412 and the sealing assembly 420, both ends of the electrode body 435 will push against the stopper 414 of the glass tube 412 as well as the stopper 423 of the sealing assembly 420 (as shown in FIG. 4A). In FIG. 4A, the conductive layer 450 is disposed on the outer surface of the electrode body 435. The material of the electrode 430 according to the present invention can be a phosphorus ceramic-glass composite, whose dielectric constant owns better temperature stability. Alternatively, the material can be a ceramic-glass composite that has no phase transition point at or above −30° C. The electrode 430 is formed by a ceramic-glass composite using a powder injection molding process or a dry stamping process.

Except for the plurality of electrodes 430, all inner sidewalls of the glass tube 412 and the plurality of sealing assemblies 420 of the fluorescent lamp 400 are coasted with phosphorus. The gases filled into the fluorescent lamp 400 include Ne, Ar, and Hg. If Hg is not used, xenon (Xe) can be used instead. Before filling the gas into the glass tube 412, the glass tube 412 has to be vacuumed first, which is to connect a vacuum pump to both ends of the glass tube 412 for removing the air in the glass tube 412 by suction. Afterwards, fill the gases including Ne, Ar, and Hg into the glass tube 412. Next, perform a heat process on the plurality of sealing assemblies 420 for sealing the original openings of the plurality of sealing assemblies 420 and accordingly sealing both ends of the glass tube 412.

A preferred embodiment of the ceramic-glass composite of the plurality of electrodes 430 includes founding glass with high sputter resistivity such as glass frits. Sputtering is a phenomenon causing partial damages inside the plurality of electrodes 430 of the fluorescent lamp 400. The damages are resulted from bombardments of inert elements, such as Ar cations, Hg ions, or electrons on the inner sidewalls of the plurality of electrodes 430. According to an embodiment of the present invention, the glass tube 412 is composed by leadless glass having a heat expansion coefficient similar to that of a ceramic-glass composite.

Figure 6:
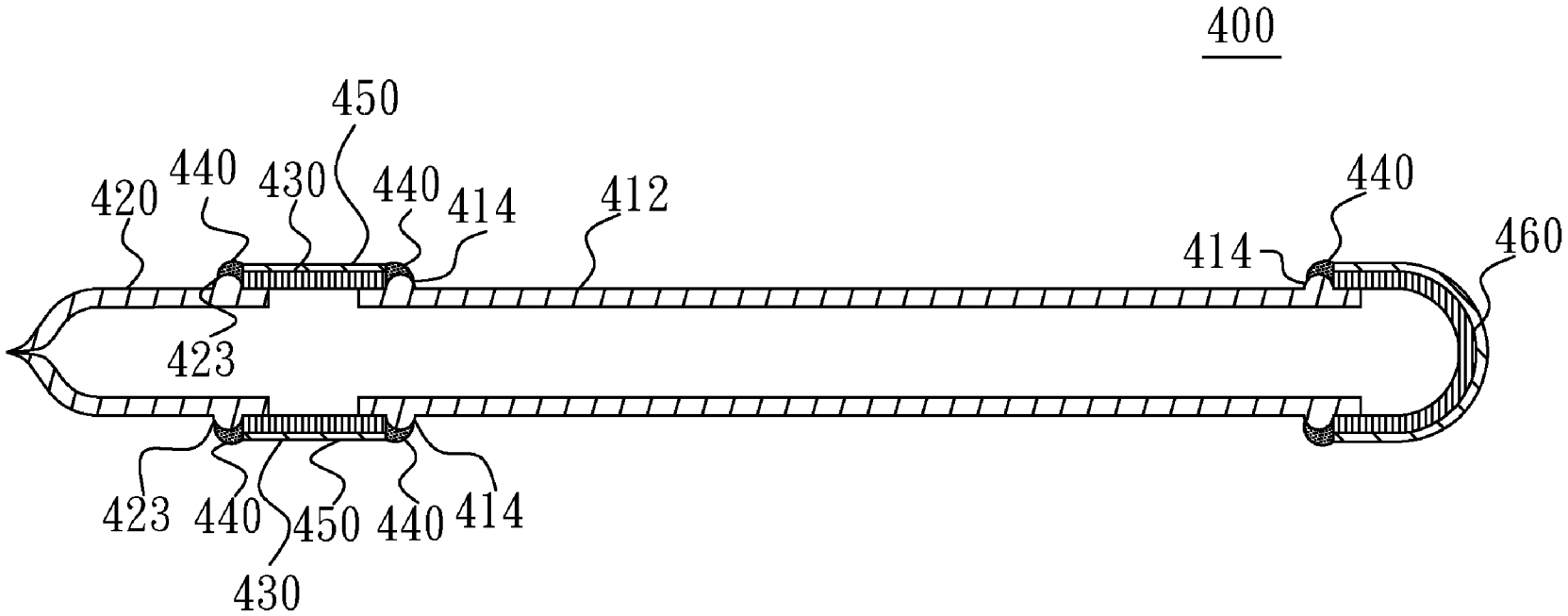
FIG. 6 shows a cross-sectional view of a fluorescent lamp having ceramic-glass composite electrodes according to a second preferred embodiment of the present invention.

FIG. 6 shows a cross-sectional view of a fluorescent lamp having ceramic-glass composite electrodes according to a second preferred embodiment of the present invention. As shown in the figure, an electrode 460 of the fluorescent lamp 400 according to the present embodiment is cup-shaped and is a ceramic-glass composite electrode as well. The electrode 460, like the cylindrical electrode 430, has only one inner radius and exhibit straight tube-shaped inside. The electrode 460 slips on an end of the glass tube 412 and pushes against the stopper 414 of the glass tube 412. The adhesive 440 is coated at the junction between the electrode 460 and the glass tube 412 for fixing the electrode 460 at the end of the glass tube 412 and preventing the gases in the glass tube from leakage and affecting the lifetime of the glass tube 400. Because the electrode 460 according to the present embodiment is cup-shaped, it can seal one end of the glass tube 412 directly without the need of using the sealing assembly 420.

According to a first embodiment of the present invention, the material of the electrodes 430, 460 includes the following compositions.

Formula 1: $(CaO—MgO—SrO—ZrO_2—TiO_2)$+Glass frits A

The proportions of the compositions in the material of Formula 1 (Samples EC1 to EC6) are shown in Table 1; their dielectric constants and losses are measured at room temperature. The results are shown in Table 1 as follows.

TABLE 1

| Sample | Compositions (mol) CaO | MgO | SrO | $ZrO_2$ | $TiO_2$ | Dielectric Constant | Dielectric Loss (%) |
|---|---|---|---|---|---|---|---|
| EC1 | 0.65 | 0.05 | 0.3 | 0.97 | 0.03 | 32.3 | 0.19 |
| EC2 | 0.65 | 0.05 | 0.3 | 0.9 | 0.1 | 38.2 | 0.1 |
| EC3 | 0.65 | 0.05 | 0.3 | 0.8 | 0.2 | 51.1 | 0.12 |
| EC4 | 0.65 | 0.05 | 0.3 | 0.7 | 0.3 | 66.2 | 0.15 |
| EC5 | 0.65 | 0.05 | 0.3 | 0.6 | 0.4 | 84.8 | 0.12 |
| EC6 | 0.65 | 0.05 | 0.3 | 0.5 | 0.5 | 105.1 | 0.25 |

The glass-frit additive adopted is the leadless glass SF-44 used in glass tubes. Because its heat expansion coefficient is $95\times10^{-7}$/K, the heat expansion coefficient can be adjusted by adding 0.6 mol of BaO and 0.4 mol of CaO to 1 mol of $SiO_2$. Alternatively, add 0.3~10 wt % of glass frits, which has identical compositions as leadless glass, based on the total amount of the sample. Next, synthesize the compositions at 1,000° C. Then, further add 3 wt % of MnO and $Al_2O_3$.

Figure 7:
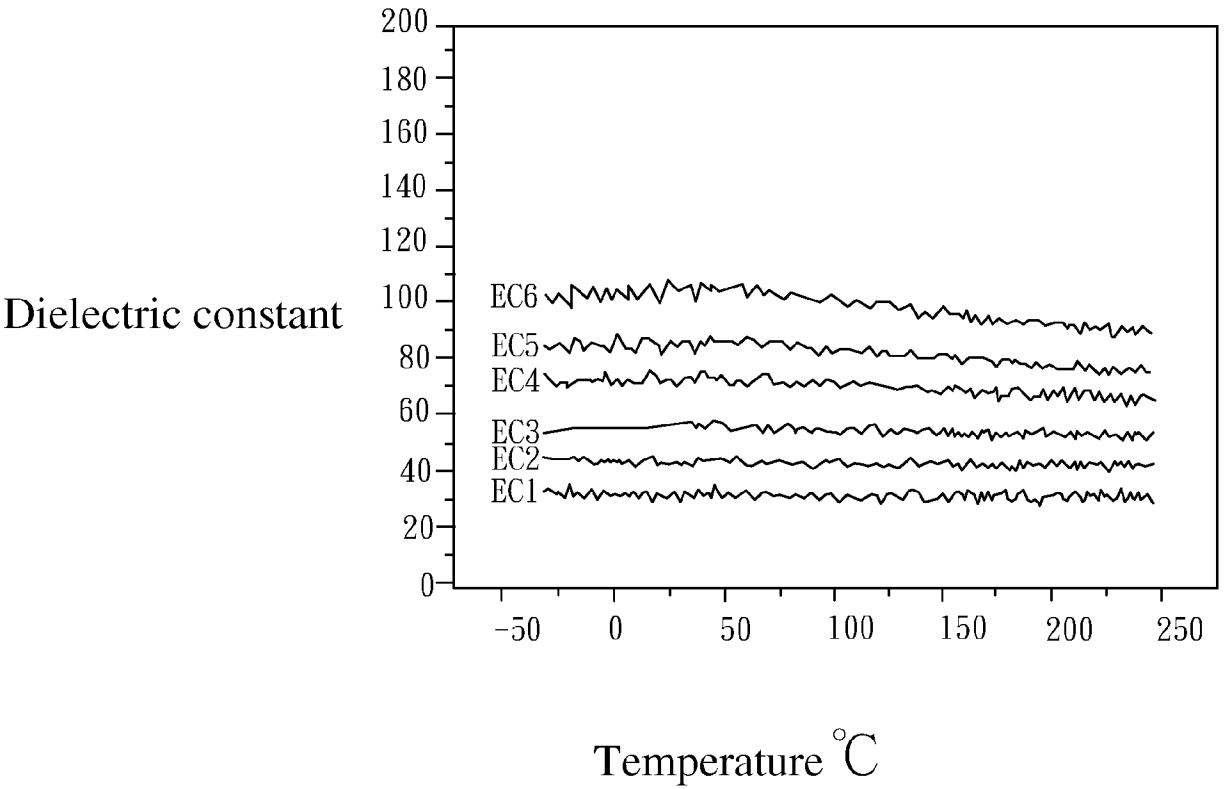
FIG. 7 shows a dielectric constant versus temperature curve according to a preferred embodiment of the present invention.

From Table 1, it is clearly shown that when the quantity of $TiO_2$ is increased, the dielectric constant will be raised. While manufacturing the fluorescent lamp and applying an AC voltage above 1,000$V_{rms}$ to the ceramic-glass composite having the compositions as adopted by the electrode, the reduction in heat generation will be proportional to the reduction of dielectric loss. Under such a circumstance, the dielectric loss can be reduced to approximately 0.1% by the addition of MnO and $Al_2O_3$. Besides, for improving the stability of the fluorescent lamp as the temperature changes, the dielectric constant of the ceramic-glass composite should have stability in high temperatures. The stability of the dielectric constant for individual composition is shown in FIG. 7. According to FIG. 7, it is shown that all of the compositions of the electrode have a stable variation in dielectric constants within the temperature range of −30° C. to 250° C. Thereby, it is observed that when the dielectric constant is low, the temperature stability is improved. Accordingly, it is confirmed that the compositions of the electrode according to the first embodiment of the present invention have dielectric constants higher than normal glass; the dielectric constants of the compositions also exhibit better temperature stability.

The performance of the fluorescent lamp having ceramic-glass composite electrodes is superior to the fluorescent lamp having external electrodes. The comparison is shown in Table 2. The table compares the fluorescent lamp according to the present invention with the fluorescent lamp according to the prior art having identical diameters and lengths. A high-voltage probe and a current sensor by Tektronix are used for measuring the current and voltage flowing through and across both ends of the fluorescent lamps. Then, a luminance meter BM-7A is used for measuring the brightness. The results are shown in Table 2 as below.

TABLE 2

| Fluorescent Lamp | Dimensions: External Diameter * Total Length (mm) | Length of Electrode (mm) | Number of Fluorescent Lamps | Input Power (Watt) | Brightness (cd/m²) |
|---|---|---|---|---|---|
| Fluorescent Lamp Having External Electrodes according to the Prior Art | 8 * 360 | 15 | 2 | 9 | 5200 |

TABLE 2-continued

| Fluorescent Lamp | Dimensions: External Diameter * Total Length (mm) | Length of Electrode (mm) | Number of Fluorescent Lamps | Input Power (Watt) | Brightness (cd/m²) |
|---|---|---|---|---|---|
| Fluorescent Lamp according to the Present Invention (Adopting EC1 Electrode) | 8 * 360 | 15 | 2 | 16 | 22000 |

According to Table 2, it is known that the fluorescent lamp according to the present invention adopts the EC1 electrode, which has the lowest dielectric constant in the first embodiment. The length of the fluorescent lamp according to the present invention is identical to that of the fluorescent lamp according to the prior art. The input power of the fluorescent lamp according to the prior art is 9 Watt; the input power of the fluorescent lamp according to the present invention is 16 Watt, which is approximately 0.7 times higher. In addition, because an inverter is used for driving two fluorescent lamps, parallel driving of fluorescent lamps can be implemented.

By using different ceramic-glass composite electrodes, the brightness for various dielectric constants can be determined. The results are shown in Table 3.

TABLE 3

| Fluorescent Lamp | | Dimensions: External Diameter * Total Length (mm) | Length of Electrode (mm) | Number of Fluorescent Lamps | Input Power (Watt) | Brightness (cd/m²) |
|---|---|---|---|---|---|---|
| Fluorescent Lamp Having External Electrodes according to the Prior Art | | 8 * 360 | 15 | 2 | 9 | 5200 |
| Fluorescent Lamp according to the Present Invention | EC1 | 8 * 360 | 15 | 2 | 16 | 22000 |
| | EC2 | | | | | 22500 |
| | EC3 | | | | | 23200 |
| | EC4 | | | | | 26000 |
| | EC5 | | | | | 27500 |
| | EC6 | | | | | 31000 |

Figure 8:
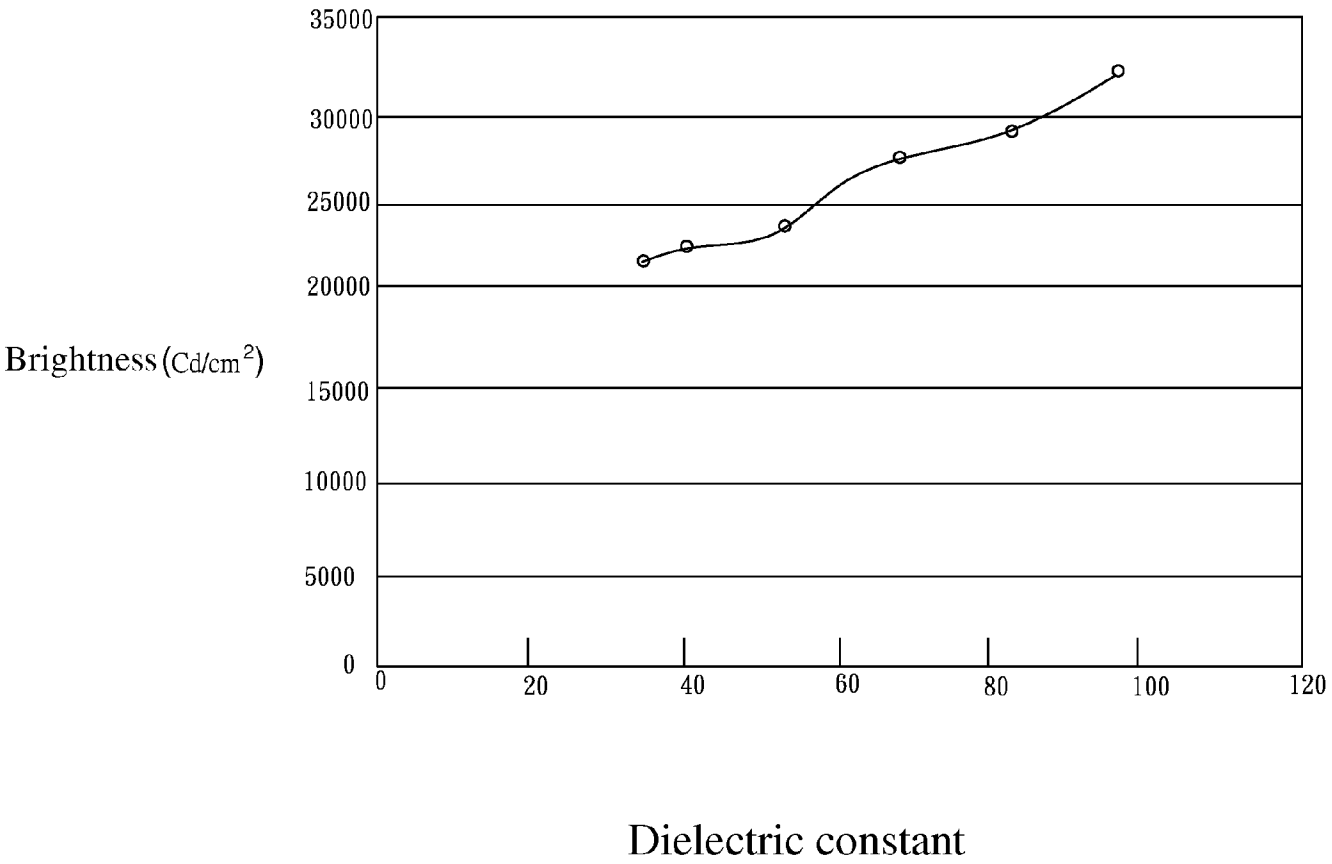
FIG. 8 shows a brightness versus dielectric constant curve according to a preferred embodiment of the present invention.

As shown in Table 3, when the input power is the same, brightness is proportional to dielectric constants. For describe this relationship in a simple way, FIG. 8 shows the relation between brightness and dielectric constant.

In addition, in order to compare the performance of the fluorescent lamp having the electrodes according to the first embodiment with the fluorescent lamp having external electrodes, the properties of the fluorescent lamp having external electrodes in a 32-inch TFT-LCD TV can be compared to those of the fluorescent lamp according to the present invention. The results are summarized in Table 4 as follows.

TABLE 4

| Fluorescent Lamp | | Dimensions External Diameter * Total Length (mm) | Dimensions Length of Electrode (mm) | Number of Fluorescent Lamps | Input Power (Watt) | Brightness (cd/m$^2$) |
|---|---|---|---|---|---|---|
| Fluorescent Lamp Having External Electrodes according to the Prior Art | | 4 * 720 | 25 | 2 | 15 | 9000 |
| Fluorescent Lamp according to the Present Invention | EC1 | 4 * 720 | 15 | 2 | 28 | 32000 |
| | EC2 | | | | | 33200 |
| | EC3 | | | | | 36000 |
| | EC4 | | | | | 42000 |
| | EC5 | | | | | 45200 |
| | EC6 | | | | | 52000 |

From Table 4, it is known that the brightness of the fluorescent lamp according to the present invention is higher than that of the fluorescent lamp having external electrodes according to the prior art.

As described above, in comparison with the fluorescent lamp having external electrodes according to the prior art, the fluorescent lamp having ceramic-glass composite electrodes according to the present invention can reach high brightness by three times or above in parallel driving conditions.

According to a second embodiment of the present invention, the material of the ceramic-glass composite electrodes includes the following compositions.

$$(CaO—MgO—SrO—ZrO_2—TiO_2)+\text{Glass frits B} \qquad \text{Formula 2:}$$

The proportions of the compositions in the material of Formula 2 are shown in Table 5; their dielectric constants and losses are measured at room temperature. The results are shown in Table 5 as follows.

TABLE 5

| Sample | Compositions (mol) CaO | MgO | SrO | $ZrO_2$ | $TiO_2$ | Dielectric Constant | Dielectric Loss (%) |
|---|---|---|---|---|---|---|---|
| ECB1 | 0.65 | 0.05 | 0.3 | 0.97 | 0.03 | 25.0 | 0.12 |
| ECB2 | 0.65 | 0.05 | 0.3 | 0.9 | 0.1 | 28.0 | 0.1 |
| ECB3 | 0.65 | 0.05 | 0.3 | 0.8 | 0.2 | 41.0 | 0.12 |
| ECB4 | 0.65 | 0.05 | 0.3 | 0.7 | 0.3 | 54.0 | 0.15 |
| ECB5 | 0.65 | 0.05 | 0.3 | 0.6 | 0.4 | 65.4 | 0.12 |
| ECB6 | 0.65 | 0.05 | 0.3 | 0.5 | 0.5 | 88.5 | 0.13 |

The glass-frit additive adopted is the borosilicate used in glass tubes. Because its heat expansion coefficient is $33\times10^{-7}$/K, the heat expansion coefficient can be adjusted by adding 75 wt % of $SiO_2$, 18 wt % of $B_2O_3$, 4 wt % of $Na_2O$, 2 wt % of $K_2O$, and 1 wt % of $Al_2O_3$. Synthesize the glass frits at 1,100° C., and then add the synthesized material to 0.3~10 wt % of the total amount of the compositions shown in Table 5. Besides, MnO and $Al_2O_3$ can be used as additives with quantity of 3 wt %.

The heat expansion coefficient of the ceramic-glass composite electrode is $36\sim60\times10^{-7}$/K, this is reduced as the amount of the glass additives is increased. In addition, according to the types of the compositions of the glass frits, the dielectric constants according to the present embodiment are different from the ones according to Formula 1. Table 5 shows the dielectric constants and losses when the glass frits B is increased by 5 wt %. From Table 5, it is clearly shown that when the quantity of $TiO_2$ is increased, the dielectric constant will be raised. While manufacturing the fluorescent lamp and applying an AC voltage above 1,000$V_{rms}$ to the ceramic-glass composite having the compositions as adopted by the electrode according to the second embodiment of the present invention, the reduction in heat generation will be proportional to the reduction of dielectric loss. Under such a circumstance, the dielectric loss can be reduced to approximately 0.1% by the addition of MnO and $Al_2O_3$.

The performance of the fluorescent lamp having ceramic-glass composite electrodes with compositions described above and manufactured using the method according to the first embodiment is compared with the fluorescent lamp having external electrodes according to the prior art. The results are shown in Table 6.

TABLE 6

| Fluorescent Lamp | | Dimensions External Diameter * Total Length (mm) | Dimensions Length of Electrode (mm) | Number of Fluorescent Lamps | Input Power (Watt) | Brightness (cd/m$^2$) |
|---|---|---|---|---|---|---|
| Fluorescent Lamp Having External Electrodes according to the Prior Art | | 3 * 720 | 15 | 2 | 12 | 12000 |
| Fluorescent Lamp according to the Present Invention | ECB1 | 3 * 720 | 15 | 2 | 22 | 41000 |
| | ECB2 | | | | | 43200 |
| | ECB3 | | | | | 46000 |
| | ECB4 | | | | | 51500 |
| | ECB5 | | | | | 54300 |
| | ECB6 | | | | | 59000 |

According to Table 6, the brightness of the fluorescent lamp having ceramic-glass composite electrode according to the second embodiment is at least three times that of the fluorescent lamp having external electrodes according to the prior art; parallel driving processes can also be implemented. By using borosilicate as the glass tube of the fluorescent lamp, the compositions of the ceramic-glass composite can be controlled for adjusting the heat expansion coefficient. Thereby, while sealing the glass tube and the fluorescent lamp using glass-sealing materials via heat processes, failures due to differences in heat expansion coefficients can be voided, and the brightness can be further improved as well.

Figure 9:
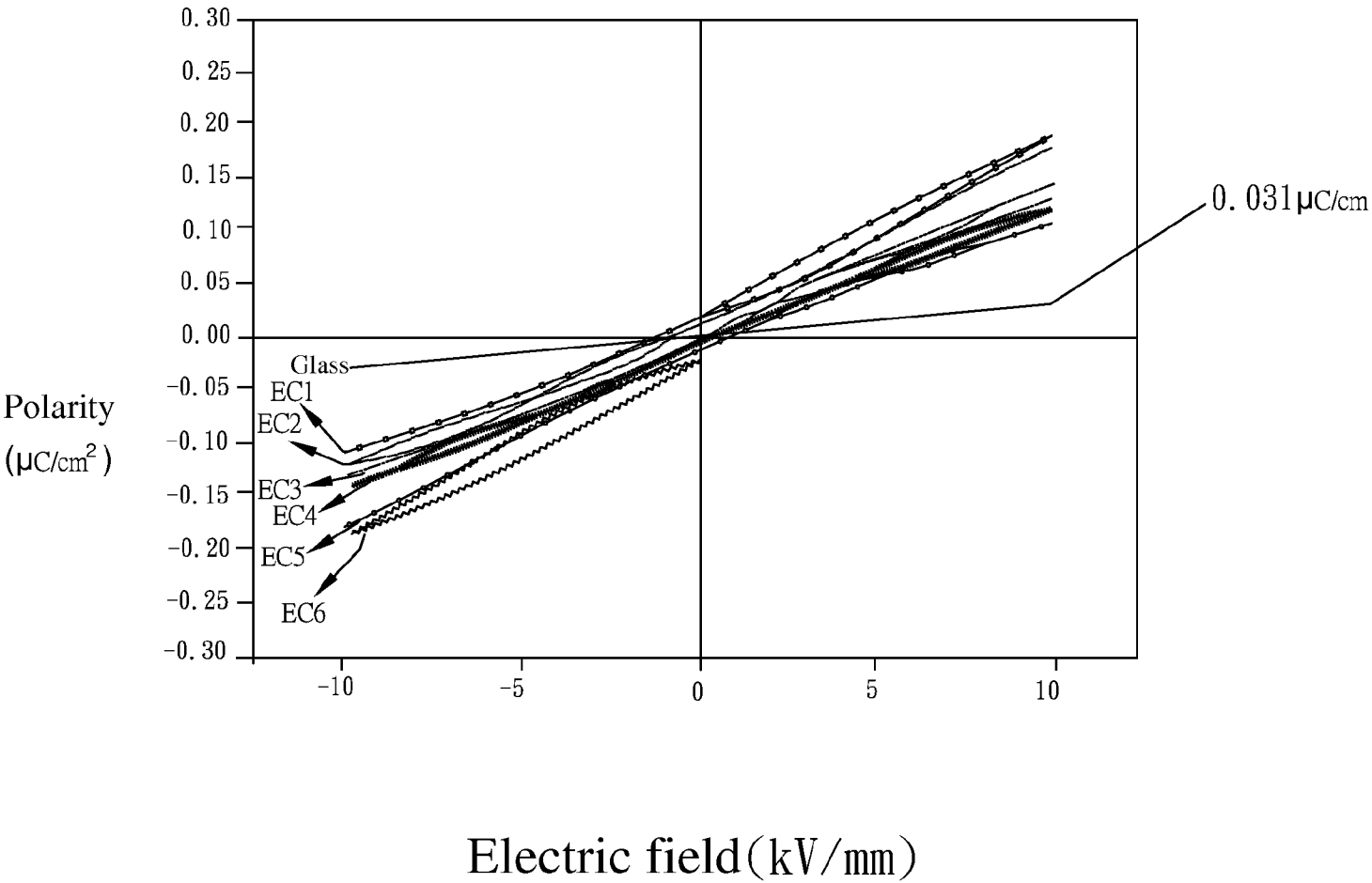
FIG. 9 shows polarity versus electric field curves according to a preferred embodiment of the present invention.

In order to understand the reasons why the brightness of the fluorescent lamp according to the present invention is raised in more details, polarity measurements are performed on each of the compositions for the electrodes shown in Table 1. Polarity depends on the electric field applied across the electrodes. The results are shown in FIG. 9. FIG. 9 shows hysteresis curves, which represent the relationship between polarity and electric field. According to the hysteresis curves shown in FIG. 9, hysteresis losses can be determined. When the hysteresis losses are increased, heat losses will increase under AC electric fields. Thereby, stable driving processes can be implemented at lower hysteresis losses. The present invention uses the following equations to determine the hysteresis losses.

Figure 10:
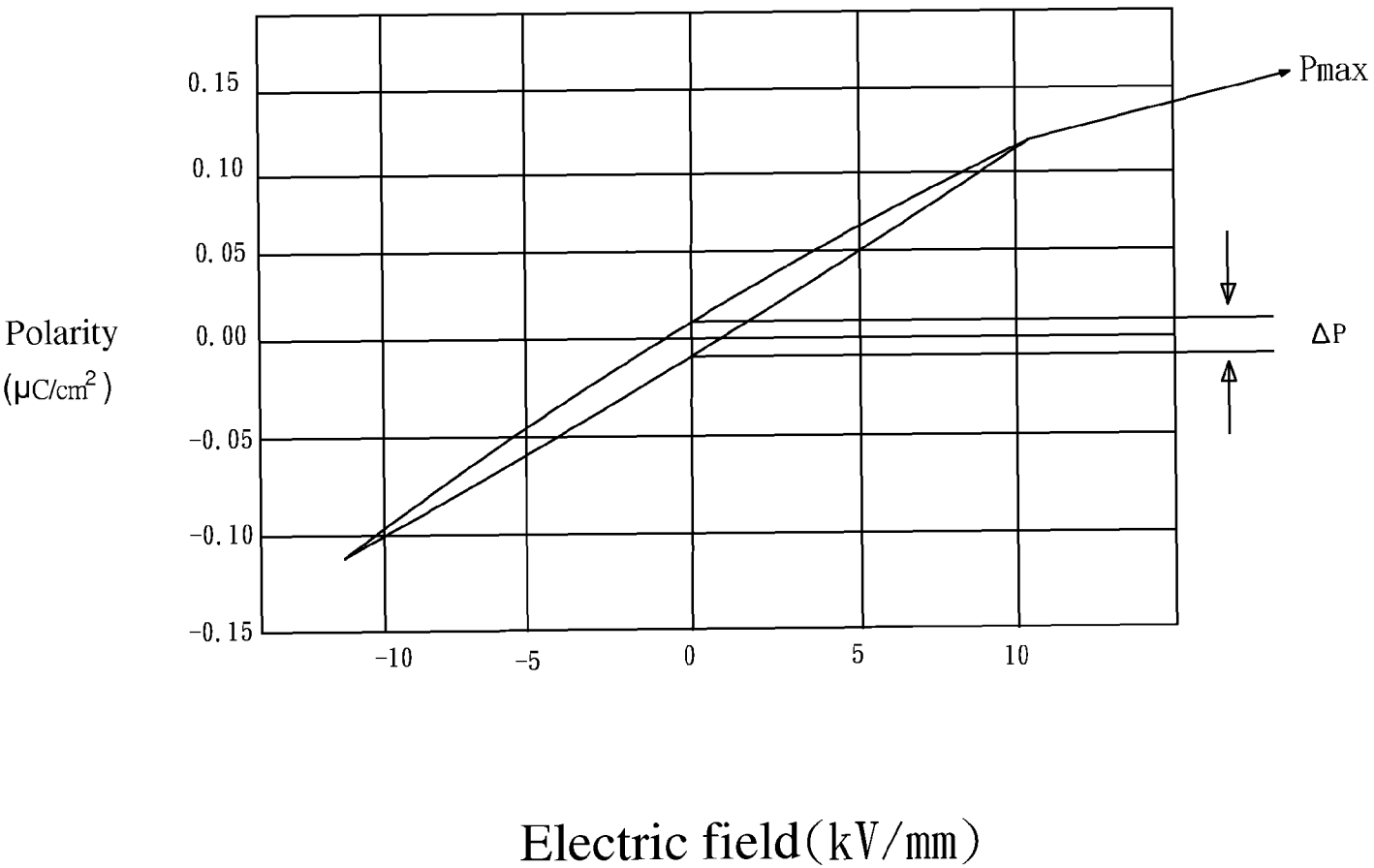
FIG. 10 shows a polarity versus electric field curve according to a preferred embodiment of the present invention.

As shown in FIG. 10, the maximum polarity occurred at 10 kV/mm is expressed as $P_{max}$; the polarity difference at 0 kV/mm is expressed as $\Delta P$. Then the hysteresis loss can be expressed as:

$$\text{Hysteresis Loss (\%)}=\Delta P/P_{max}\times100$$

According to the above equation, the data in FIG. 10 are used for determining hysteresis loss. The results are shown in Table 7.

TABLE 7

| | Glass | EC1 | EC2 | EC3 | EC4 | EC5 | EC6 |
|---|---|---|---|---|---|---|---|
| Hysteresis Loss (%) | 16 | 13 | 9 | 12 | 14 | 5.5 | 5.2 |

It is known from the results that, compared to glass electrodes according to the prior art, the fluorescent according to the present invention exhibits relatively stable hysteresis loss at the high electric field of 10 kV/mm.

Accordingly, in comparison with the fluorescent lamp having external electrode composed only by glass according to the prior art, the feature of the fluorescent lamp having ceramic-glass composite electrodes according to the present invention is that, while applying identical electrical fields, the amount of ions or electrons appeared in the fluorescent lamp according to the present invention is at least twice that appeared in the fluorescent lamp according to the prior art. Moreover, as compared to the fluorescent lamp having external electrodes composed simply by glass according to the prior art, the fluorescent lamp having low hysteresis loss can provide light at a stable temperature under high voltages. The ceramic-glass composite according to the present invention has polarity higher than that of glass. The maximum polarity of glass under 10 kV/mm electric field is 0.031 $\mu C/cm^2$; the polarity change linearly as a function of electric field.

In the embodiment described above, the MgO—SrO compositions can be replaced by oxides having differences in ion radius equal to or below 15%. The examples of replaceable oxides are shown in Table 8 below.

TABLE 8

| Ions | Ion Radius (Å) | Replaceable Examples | Ion Radius (Å) | Δ Ion Radius (%) |
|---|---|---|---|---|
| $Ca^{2+}$ | 1.0 | $Y^{3+}$, $Yb^{3+}$ | 0.89, 0.86 | 11, 14 |
| | | $Sm^{2+}$ | 0.96 | 4 |
| | | $La^{3+}$ | 1.06 | 6 |
| | | $Nd^{3+}$ | 1.00 | 0 |
| $Mg^{2+}$ | 0.72 | $Bi^{2+}$ | 0.74 | 2.7 |
| | | $Li^{1+}$ | 0.74 | 2.7 |
| | | $Ni^{2+}$ | 0.69 | 3 |
| $Sr^{2+}$ | 1.16 | $Eu^{3+}$ | 0.59 | 15 |
| $Zr^{4+}$ | 0.72 | $Nb^{5+}$ | 0.64 | 11 |
| | | $Mo^{4+}$ | 0.65 | |
| | | $Fe^{2+}$, $Fe^{3+}$ | 0.77, 0.65 | |
| | | $Zn^{2+}$, $Sc^{3+}$ | 0.75, 0.73 | |
| | | $Mn^{2+}$ | 0.67 | |
| $Ti^{4+}$ | 0.61 | $Cr^{3+}$ | 0.62 | |
| | | $Sb^{5+}$ | 0.61 | |
| | | $Sb^{4+}$ | 0.69 | |
| | | $Nb^{5+}$ | 0.64 | |
| | | $Mn^{4+}$ | 0.54 | |

To sum up, the present invention provides a ceramic-glass composite electrode and a fluorescent lamp having the same. The ceramic-glass composite electrode according to the present invention is a ceramic-glass composite, which is disposed at the ends of a glass tube of the fluorescent lamp. A stopper is disposed at the end of the glass tube for pushing against the ceramic-glass composite electrode and limiting the position of the ceramic-glass composite electrode slipped on the glass tube. Thereby, flowing of adhesives into the glass tube is avoided when the adhesives are used for gluing the glass tube and the ceramic-glass composite electrode, and hence extending the lifetime of the fluorescent lamp. The ceramic-glass composite electrode according to the present invention comprises an electrode body, which is disposed at the end of the glass tube of the fluorescent lamp and is a cylinder having only one inner radius.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A fluorescent lamp having ceramic-glass composite electrodes, comprising:

a glass tube;

at least a stopper, disposed at at least an end of said glass tube; and a plurality of ceramic-glass composite electrodes, disposed at both ends of said glass tube, respectively, pushing against said stopper of said glass tube, and being a ceramic-glass composite, wherein said stopper is connected at a glass tube wall in a same plane of the glass tube wall.

2. The fluorescent lamp having ceramic-glass composite electrodes of claim 1, wherein said ceramic-glass composite electrode is a cylinder having only one inner radius and is straight tube-shaped inside.

3. The fluorescent lamp having ceramic-glass composite electrodes of claim 1, further comprising a plurality of conductive layers disposed on the outer surface of said plurality ceramic-glass composite electrodes, respectively.

4. The fluorescent lamp having ceramic-glass composite electrodes of claim 1, further comprising a plurality of sealing assemblies disposed at ends of said plurality of ceramic-glass composite electrodes, respectively.

5. The fluorescent lamp having ceramic-glass composite electrodes of claim 4, wherein said plurality of sealing assemblies have a stopper, respectively, for pushing against said ends of said plurality of ceramic-glass composite electrodes.

6. The fluorescent lamp having ceramic-glass composite electrodes of claim 1, wherein said stopper is protrudent and annular.

7. A ceramic-glass composite electrode, comprising an electrode body, disposed at an end of a glass tube of a fluorescent lamp, being a cylinder and a ceramic-glass composite, and said cylinder having only one inner radius, wherein a stopper is disposed and connected at the end of the glass tube in a same plane as the glass tube.

8. The ceramic-glass composite electrode of claim 7, further comprising a conductive layer disposed on an outer surface of said electrode body.

9. The ceramic-glass composite electrode of claim 7, wherein said electrode body is straight tube-shaped inside.

10. The ceramic-glass composite electrode of claim 7, wherein said electrode body pushes against said stopper located at said end of said glass tube.

* * * * *